US009149119B2

(12) United States Patent
Hansel et al.

(10) Patent No.: US 9,149,119 B2
(45) Date of Patent: Oct. 6, 2015

(54) VENTILATED SHELF COVER WITH SPRING CLASP

(71) Applicant: Customer Motivators, LLC, Boynton Beach, FL (US)

(72) Inventors: Jeff Hansel, Boynton Beach, FL (US); James Cashion, Boynton Beach, FL (US)

(73) Assignee: Customer Motivators, LLC, Boynton Beach, FL (US)

( * ) Notice: Subject to any disclaimer, the term of this patent is extended or adjusted under 35 U.S.C. 154(b) by 0 days.

(21) Appl. No.: 14/192,188

(22) Filed: Feb. 27, 2014

(65) Prior Publication Data

US 2014/0263131 A1 Sep. 18, 2014

Related U.S. Application Data

(63) Continuation-in-part of application No. 13/654,552, filed on Oct. 18, 2012, now Pat. No. 8,871,324.

(60) Provisional application No. 61/778,531, filed on Mar. 13, 2013.

(51) Int. Cl.

| | |
|---|---|
| ***A47B 95/04*** | (2006.01) |
| ***A47F 5/00*** | (2006.01) |
| ***A47B 96/02*** | (2006.01) |
| *A47F 5/01* | (2006.01) |

(52) U.S. Cl.

CPC ..... *A47B 95/04* (2013.01); *A47B 96/021* (2013.01); *A47F 5/0043* (2013.01); *A47F 5/01* (2013.01)

(58) Field of Classification Search

CPC ..... B32B 3/06; F25D 25/02; A47F 5/13; A47F 5/0846; A47F 5/0043; A47F 5/01; A47B 96/00; A47B 95/04; A47B 96/021; A47B 96/063; A47B 95/043; A47B 2095/046; A47B 47/0083; A47B 57/08; A47B 87/0246; A47B 55/02; A47B 97/00; A47B 96/061; A47B 45/00; A47B 61/003

USPC ..... 211/119.003, 183, 90.03, 90.01, 153, 211/106, 181.1; 108/27; 428/99

See application file for complete search history.

(56) References Cited

U.S. PATENT DOCUMENTS

| | | | | |
|---|---|---|---|---|
| 1,524,793 | A | 2/1925 | Lemery | |
| 2,144,513 | A | 1/1937 | Smith | |
| 2,309,212 | A * | 1/1943 | Reeves | 211/153 |

(Continued)

OTHER PUBLICATIONS

Shelfanator, www.youtube.com, "Shelfanator", Nov. 26, 2007.

(Continued)

*Primary Examiner* — Jennifer E Novosad

(74) *Attorney, Agent, or Firm* — Fleit Gibbons Gutman Bongini & Bianco PL; Jon A. Gibbons

(57) ABSTRACT

A novel ventilated shelving cover is disclosed that transforms the appearance of wire shelves to cover the white vertical and horizontal bars with a clean sleek decorative trim (crown molding) giving the shelves a custom made look. While also utilizing a custom insert/liner to enhance the functionality by keep items from tipping or falling through the wire portion of the shelves. This system contains a decorative trim piece, decorative cover, specially engineered clasps and an insert/liner. The system also includes a custom saw and miter to provide "All You Need" to accomplish the transformation of your pantry, linen, bedroom closets or garage shelves.

18 Claims, 12 Drawing Sheets

(56) References Cited

U.S. PATENT DOCUMENTS

| | | | | | |
|---|---|---|---|---|---|
| 2,599,607 | A | * | 6/1952 | Burrise | 211/153 |
| 2,811,260 | A | | 10/1957 | Goldstein | |
| 3,193,108 | A | | 7/1965 | Johnson | |
| 3,637,085 | A | * | 1/1972 | Ball | 211/153 |
| 3,647,078 | A | | 3/1972 | Fortunato | |
| 3,949,880 | A | | 4/1976 | Fortunato | |
| 4,201,291 | A | | 5/1980 | Davidson | |
| 4,318,487 | A | * | 3/1982 | McCarthy | 211/134 |
| 4,606,280 | A | * | 8/1986 | Poulton et al. | 108/97 |
| 4,606,464 | A | * | 8/1986 | Jordan et al. | 211/41.8 |
| 4,698,928 | A | | 10/1987 | Soporowski | |
| 5,044,104 | A | | 9/1991 | Hopperdietzel | |
| 5,140,915 | A | | 8/1992 | Knape | |
| 5,148,928 | A | | 9/1992 | Arnold | |
| 5,228,581 | A | | 7/1993 | Palladino et al. | |
| 5,317,977 | A | | 6/1994 | Omessi | |
| 5,415,302 | A | * | 5/1995 | Carlson et al. | 211/187 |
| 5,538,147 | A | * | 7/1996 | Fucci | 211/153 |
| 5,597,077 | A | * | 1/1997 | Hartmann | 211/134 |
| 5,697,302 | A | | 12/1997 | Putnam | |
| 5,758,851 | A | * | 6/1998 | Remmers | 248/251 |
| 5,863,019 | A | | 1/1999 | Rose et al. | |
| 6,126,125 | A | | 10/2000 | Dalton | |
| 6,226,910 | B1 | | 5/2001 | Ireland | |
| 6,401,945 | B1 | | 6/2002 | Gawel | |
| 6,450,471 | B1 | | 9/2002 | Wear | |
| 6,553,702 | B1 | | 4/2003 | Bacnik | |
| 6,557,711 | B2 | | 5/2003 | Grueneberg | |
| 6,571,498 | B1 | | 6/2003 | Cyrluk | |
| 6,725,785 | B2 | | 4/2004 | Wang | |
| 6,793,185 | B2 | | 9/2004 | Joliey | |
| 6,802,146 | B2 | | 10/2004 | Gay | |
| D520,287 | S | | 5/2006 | Sparkowski | |
| 7,739,964 | B2 | | 6/2010 | Hatton | |
| 7,810,440 | B2 | | 10/2010 | Ward | |
| 7,882,969 | B2 | | 2/2011 | Gerstner et al. | |
| 8,069,994 | B2 | | 12/2011 | Barkdoll | |
| 8,167,149 | B2 | | 5/2012 | Wamsley et al. | |
| 8,172,096 | B2 | | 5/2012 | Van De Steen | |
| 8,231,016 | B2 | | 7/2012 | Berdahl et al. | |
| 8,871,324 | B2 | * | 10/2014 | Hansel et al. | 428/99 |
| 2001/0014250 | A1 | * | 8/2001 | Plummer et al. | 403/295 |
| 2002/0170870 | A1 | | 11/2002 | Callis | |
| 2003/0178384 | A1 | | 9/2003 | Speed | |
| 2004/0004052 | A1 | | 1/2004 | Young et al. | |
| 2004/0060883 | A1 | | 4/2004 | Walker | |
| 2004/0200793 | A1 | | 10/2004 | Hardy | |
| 2005/0139560 | A1 | | 6/2005 | Whiteside et al. | |
| 2006/0054063 | A1 | * | 3/2006 | Ryan | 108/27 |
| 2007/0023374 | A1 | * | 2/2007 | Nawrocki | 211/90.01 |
| 2007/0029273 | A1 | | 2/2007 | Dean et al. | |
| 2007/0251426 | A1 | * | 11/2007 | Li | 108/27 |
| 2008/0017600 | A1 | | 1/2008 | Thompson | |
| 2009/0001037 | A1 | | 1/2009 | Wilcock | |
| 2010/0078402 | A1 | | 4/2010 | Davis et al. | |
| 2010/0320164 | A1 | | 12/2010 | Clark et al. | |
| 2011/0186248 | A1 | | 8/2011 | Lefevre et al. | |
| 2014/0263131 | A1 | * | 9/2014 | Hansel et al. | 211/183 |

OTHER PUBLICATIONS www.randolphhomeproducts.com, "Randolph Home Products—Wire Shelf Covers/Liners", Jun. 28, 2009.

* cited by examiner

VENTILATED SHELF COVER WITH SPRING CLASP

CROSS-REFERENCE TO RELATED APPLICATIONS

This application is claims priority from U.S. Provisional Patent Application No. 61/778,531, filed on Mar. 13, 2013, with inventors James Cashion and Jeff Hansel, and commonly assigned herewith to Customer Motivators, LLC, which is a continuation-in-part of and claims priority from U.S. patent application Ser. No. 13/654,552, filed on Oct. 18, 2012, with inventors James Cashion and Jeff Hansel, and commonly assigned herewith to Customer Motivators, LLC, the entire disclosure of each patent application is incorporated herein by reference in its entirety.

BACKGROUND OF THE INVENTION

The present invention generally relates to shelving and more particularly covering for ventilated shelving.

Ventilated shelving, including wire shelving, is now commonly used in both new and existing construction, as well as commercial and residential properties. This is especially true in residential applications in closets, kitchen pantries, and laundry rooms. Further, at least in part, their popularity stems from their low cost, modularity, and ease of installation. For example, it is common today to use ventilated shelving (e.g., wire or plastic shelving and associated components) to construct storage units within closets.

Ventilated shelving is adaptable in that typical ventilated shelving not only varies in size and shape (e.g., different lengths and widths), and configuration (e.g., different wire mesh spacing), but may have connected thereto varied storage or attachment members.

Nevertheless, with the increased usage of these types of shelving units, problems have surfaced that are associated with this type of shelving. For example, because of the raised, typically parallel cross-bars of this type of shelving, soft articles such as clothing, when stored on the shelving, tend to develop or assume the unsightly pattern of the cross-bars, thereby requiring the wearer to iron or press the stored clothing before wearing the clothing.

Additionally, items that require storage in an upright position, once placed on the wire shelving, tend to fall over due to the lack of a fully supportive surface caused by the spacing between the cross-bars.

Yet another problem arises when the protective coating on the wire shelves begins to wear. The exposed surface, typically steel, tends to rust and thereby cause damage to the stored items. And, still further, whether or not the coating is still intact, this type of shelving is extremely difficult to thoroughly clean. This is one reason this style of shelving has not been accepted into environments that require thorough cleaning on a regular basis: for example, hospitals.

Yet still further, wire shelving has not been completely accepted into the residential or commercial industry due to its "commercial" appearance, as well as the inability to personalize or decorate the shelving, making it almost impossible to incorporate the shelving into the existing decor.

Accordingly, a need exists for novel systems and methods which have, among other advantages, increased utility, strength, variability, and adaptability, while simultaneously being easier to use and aesthetically pleasing.

SUMMARY OF THE INVENTION

A novel ventilated shelving cover is disclosed that transforms the appearance of wire shelves to cover the white vertical and horizontal bars with a clean sleek decorative trim (crown molding) giving the shelves a custom made look. While also utilizing a custom insert/liner to enhance the functionality by keep items from tipping or falling through the wire portion of the shelves.

The shelving cover system enhances the appearance and functionality of standard wire shelves. This system contains a decorative trim piece, decorative cover, specially engineered clasps and an insert/liner. The system also includes a custom saw and miter to provide "All You Need" to accomplish the transformation of your pantry, linen, bedroom closets or garage shelves In one example, the ventilated shelf cover includes a decorative front cover with a front side and a back side and a top lip and a bottom lip disposed substantially perpendicular to the back side, and at least one pair of fingers and disposed on the back side to define a channel therebetween. A substantially U-shaped or J-shaped clasp is included. The U-shape clasp is formed with a first leg and a second leg and a first end attached to the first leg and the second leg, the first end having a substantially semi-circular opening in communication with an interior slot and a second end having a slotted opening in communication with the interior slot, and a set of substantially barbell shaped finger mounts, each of the substantially bar bell shaped finger mounts with a substantially rounded top edge, a substantially flat side edge, and a straight bottom edge defining a groove for accepting one of the pair of fingers thereinto.

The ventilated shelf cover may also include a substantially flat covering with a front edge, and wherein the top lip and the back side of the decorative front cover defines a void sized to accept the front edge of the flat covering thereinto.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present invention, in which.

DETAILED DESCRIPTION

As required, detailed embodiments of the present invention are disclosed herein; however, it is to be understood that the disclosed embodiments are merely examples of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure and function. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly. The materials used to fabricate the ventilated shelving cover can be any ridged organic or inorganic material including plastic, metal, composite, wood, or a combination thereof.

Disclosed is a ventilated shelving cover enhances the appearance and functionality of standard ventilated shelves. This ventilated shelving cover contains a decorative trim piece, decorative cover, specially engineered clasps, and an insert/liner. The ventilated shelving cover also includes a custom saw and miter to provide "All You Need" to accomplish the transformation of your pantry, linen, bedroom closets or garage shelves.

The ventilated shelving cover has been designed for installation to be quick and easy. The decorative trim cover has a track that runs along the back of the entire profile. The specially engineered clasps are inserted along the decorative trim cover approximately track 4 inches apart. The specially engineered clasps are relocateable at different positions to accommodate different shelf lengths and position of shelf poles. The engineer clasps mechanically couple to the decorative trim cover to be locked onto the front portion of the wire shelf. The unique design of the clasps provides a firm hold locking the decorative front cover onto the wire shelf. Once the decorative front cover has been affixed to the wire shelf the insert/liner slides between the top inside edge of the decorative trim cover and sits securely on top of the wire shelf covering the entire width of the shelf. The decorative front cover is provided as an attractive option to be attached over the decorative front cover if the trim cover has been cut or if the wire shelves have a vertical support bar.

Figure 1:
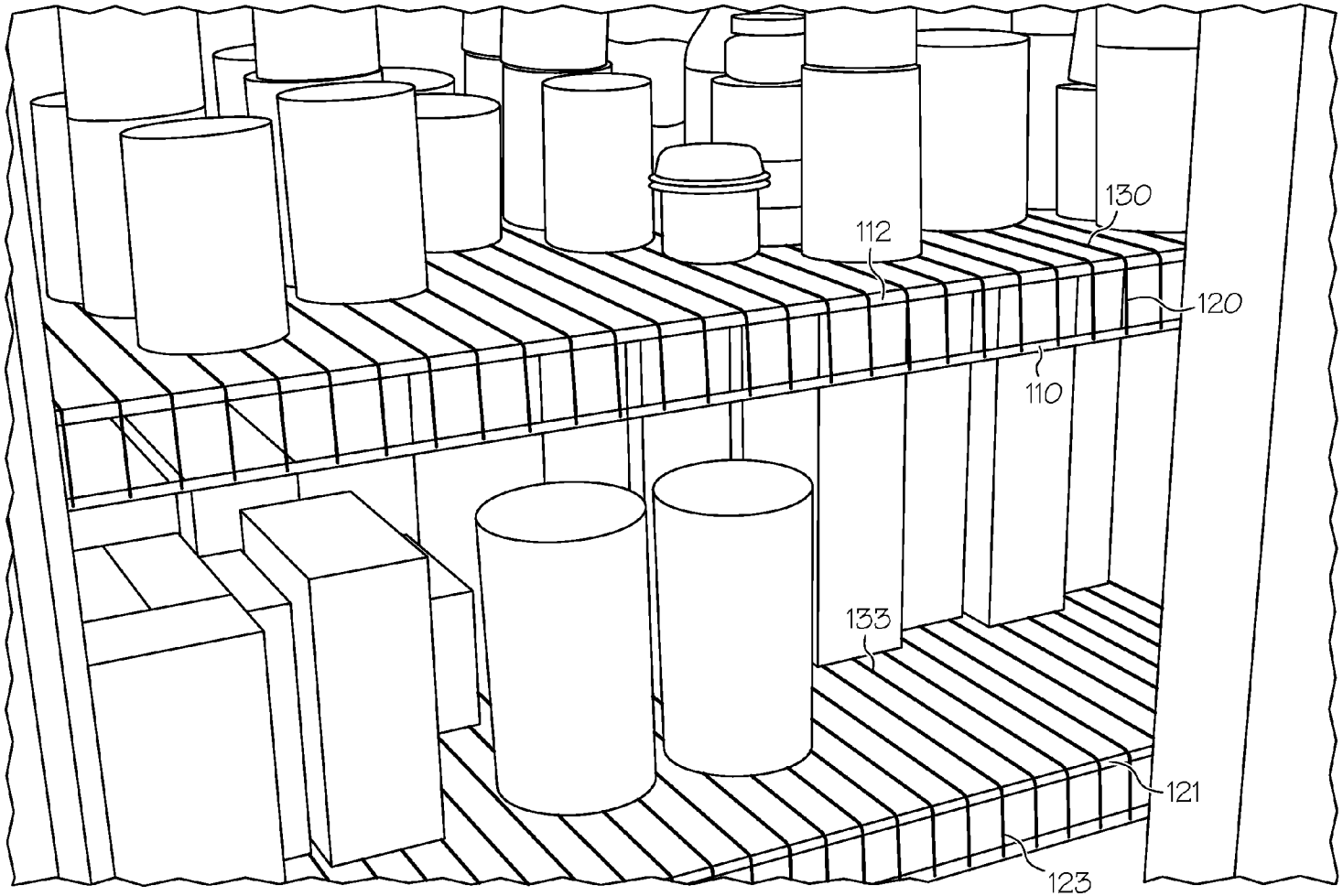
FIG. 1 (PRIOR ART)
FIG. 1 is a front perspective view of a prior art ventilated shelving system for a pantry.

Turning now to FIG. 1 shown is a front perspective view of a prior art ventilated shelving 100 for a pantry with canned and dry goods. The ventilated shelf 100 is includes a top surface 130 formed from series of wires 133 disposed substantially parallel to each other as shown. A front edge 120 is formed by a top front frame member 112 and a bottom front frame member 110 in a substantially parallel arrangement. The front edge 120 formed from the wires 133 from the top surface 130 bent around the top front member 112 and joined substantially perpendicular to the top front frame member 112 and the bottom front frame member 110. A series of rectangular areas 123 are formed on the front edge 120.

Figure 2:
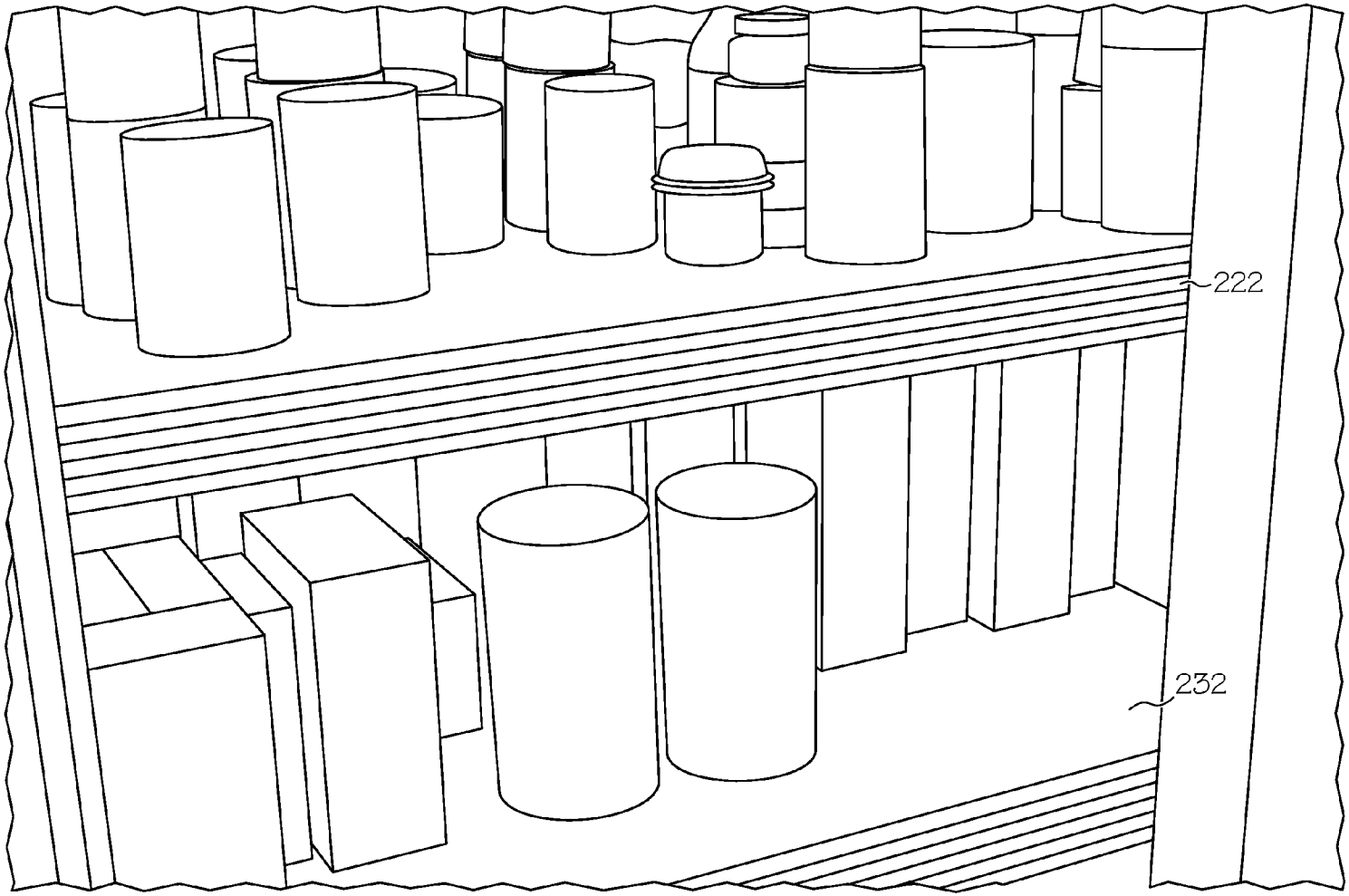
FIG. 2 is a front perspective view of a ventilated shelving cover installed over the shelving system of FIG. 1.

FIG. 2 is a front perspective view of a ventilated shelving cover 200 installed over the shelving system of FIG. 1. Two distinct features are noticeable. First the decorative front cover 222 with a front edge 234 (as shown FIG. 3) is shown attached to the front edge 120 of the ventilated shelf 100. The second feature is the top covering 232 over the wires 133 on the top surface 130. The ventilated shelving cover 200 is offered in a variety of styles, lengths and widths as well as different materials. It has been designed to be water and stain resistant and can easily be cleaned with a damp cloth.

First Model

Figure 3:
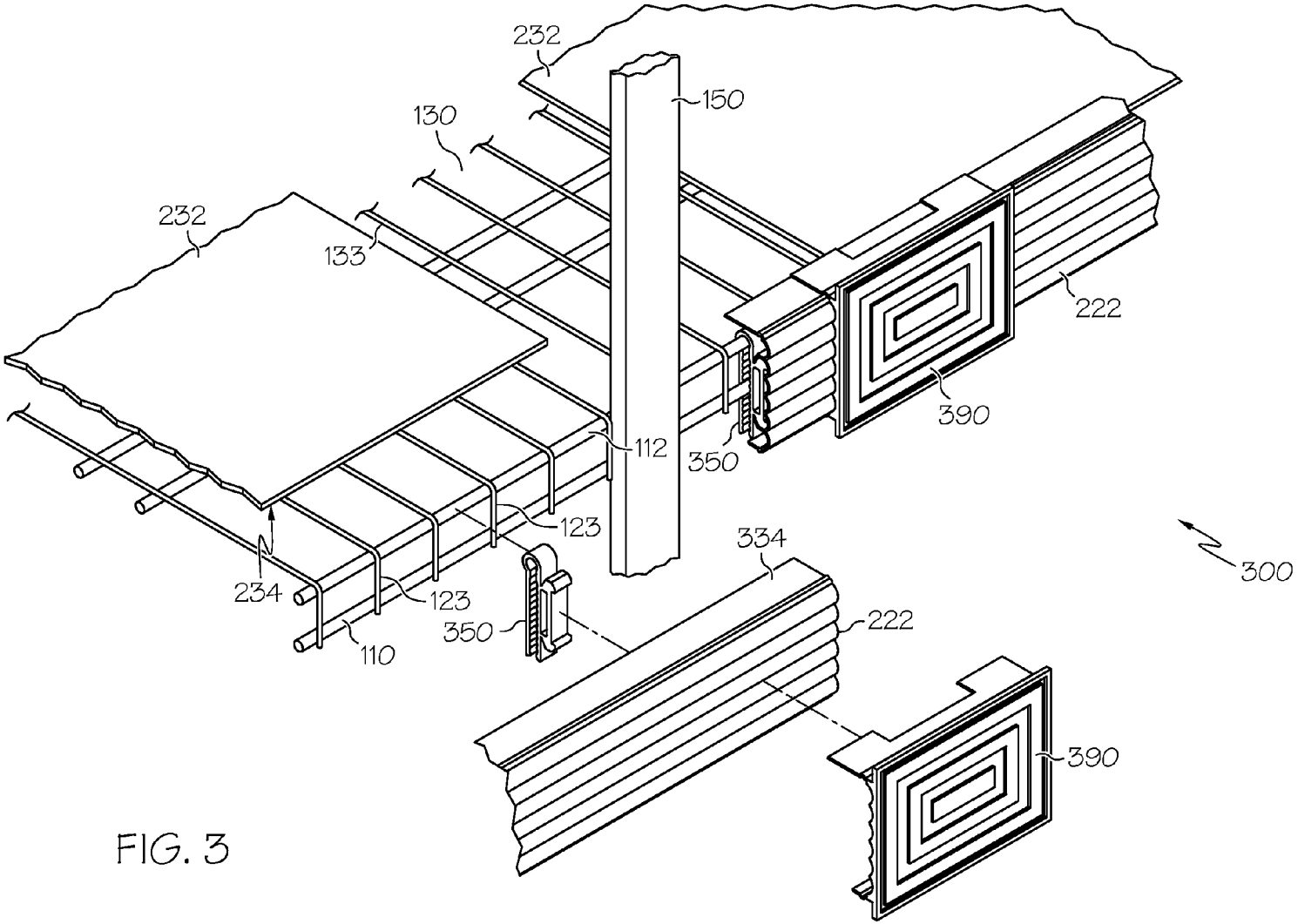
FIG. 3 is a front perspective explosion diagram illustrating major components of the ventilated shelving cover for a first model.
Figure 16:
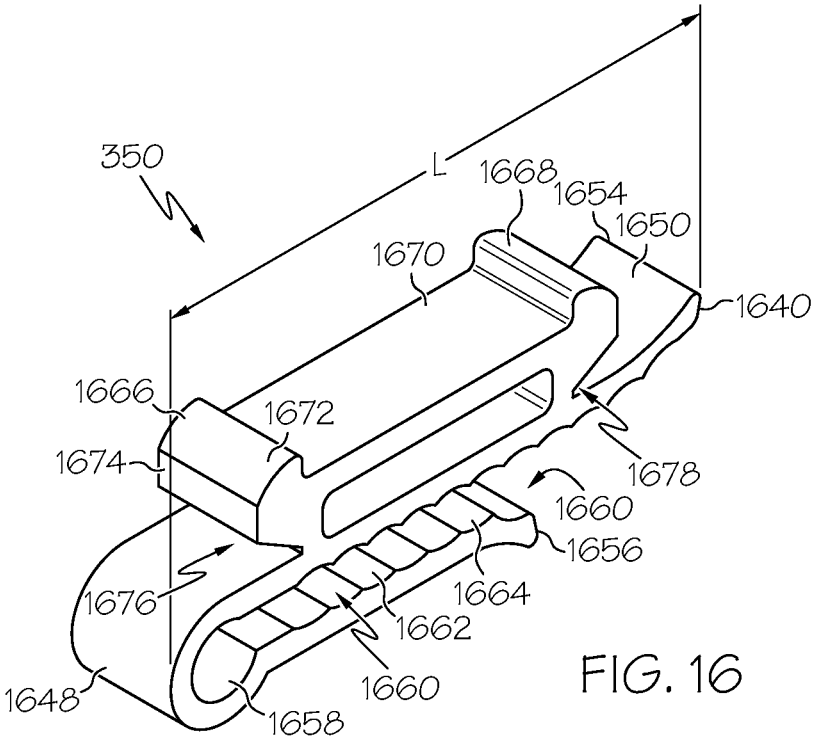
FIG. 16 is a front perspective of a clasp of FIG. 3 for the J-shaped model.

Referring to FIG. 3 shown is a front perspective explosion diagram 300 illustrating major components of the ventilated shelving cover 200 of FIG. 2 for a first model. The top covering 232 over the wires 133 on the top surface 130 and the decorative front cover 222 were described above in FIG. 2. The decorative front cover 222 as further described below includes a backside adapted to receive a clasp 350 and a top lip 334 to allow the top covering 232 to slip snugly underneath. Likewise, the clasp 350 is adapted to firmly attach to the backside of the decorative front cover 222 and over the top frame member 112 and the front edge 120 on the previously installed ventilated shelf 100. Also shown is a decorative cap 390 is used in applications in which two decorative front cover 222 pieces together for a long shelf. This decorative cap 390 is also used in applications in which a vertical support pole 150 is used as part of the ventilated wire shelf 100 of FIG. 1. FIG. 16 is a front perspective of a clasp of FIG. 3 for the J-shaped model. FIG. 16 uses like reference numerals i.e. "16xx" refer to identical or functionally similar elements "3xx" throughout already described above for FIG. 4.

Figure 4:
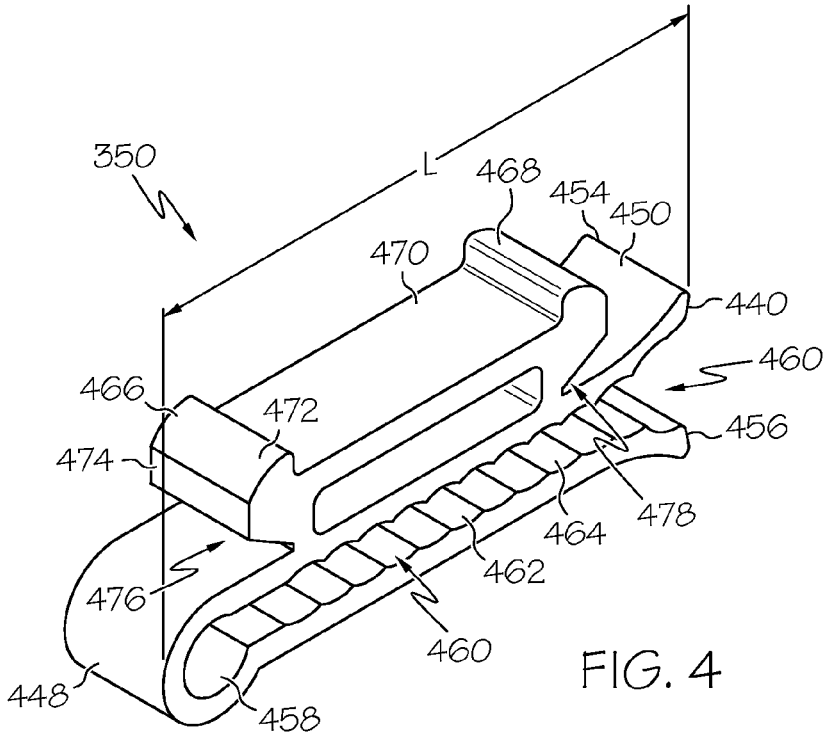
FIG. 4 is a front perspective of a clasp of FIG. 3 for the first model.

Referring now to FIG. 4 is a front perspective of a clasp 350 of FIG. 3 of the first model. The clasp 350 is substantially U-shaped with a first leg 456 and a second leg 454 joined together at a first end 442 defining a semi-circular opening 458. In one example, the approximate overall length L of the clasp 350 is approximately 2 inches to fit the front edge 120 of ventilated shelve 100, however other shorter and longer lengths are possible. The first leg 456 and the second leg 454 form a slotted opening 460 at a second end 450 in communications with an interior slot 462 that is sized to allow the top frame member 112 of the front edge 120 to pass through with a few pounds of force. In one example, the first leg 456 and the second leg 454 at second end 450 each have a bevel end 440 angled towards the opening 460. The bevel end 440 facilitates insertion over the top frame member 112 of the front edge 120. In one example, the second end 450 of the first leg 456 and the second end 450 of the second leg form a Y-shaped slotted opening therebetween as shown. However, it is important to note that in other examples this Y-shape is not included. The semi-circular opening 458 is sized to approximately 0.27 inches in order to fit firmly around the top frame member 112 of the front edge 120. A series of semi-circular ridges 464 are disposed on a surface of the first leg 456, the second leg 454 or both, facing the interior slot 462 to assist in making a firm connection around the front edge 120 of the ventilated shelf 100. Disposed on second leg 454 is a substantially H-shaped member 464 (when viewed from the side) as shown. Two finger mounts 466 and 468 are formed on each end of the H-shaped member 464 with a top surface 470. The finger mounts 466 and 468 are barbell-shaped, with a substantially rounded top edge 472, a substantially flat side edge 474, and a straight bottom edge 476. The straight bottom edge 476 of each of the finger mounts 466 and 468 defines a groove 478 which is sized to receive and couple firmly to one of a pair of fingers 546 and 548 from FIG. 5. The H-shaped member 464 is only one example of a shape that can be formed to include the finger mounts 466 and 468. In this example the H-shaped member 464 includes a rounded top edge 472, a substantially flat side edge 474, and a straight bottom edge 476 and other shapes are within the true scope of the present application.

Figure 5:
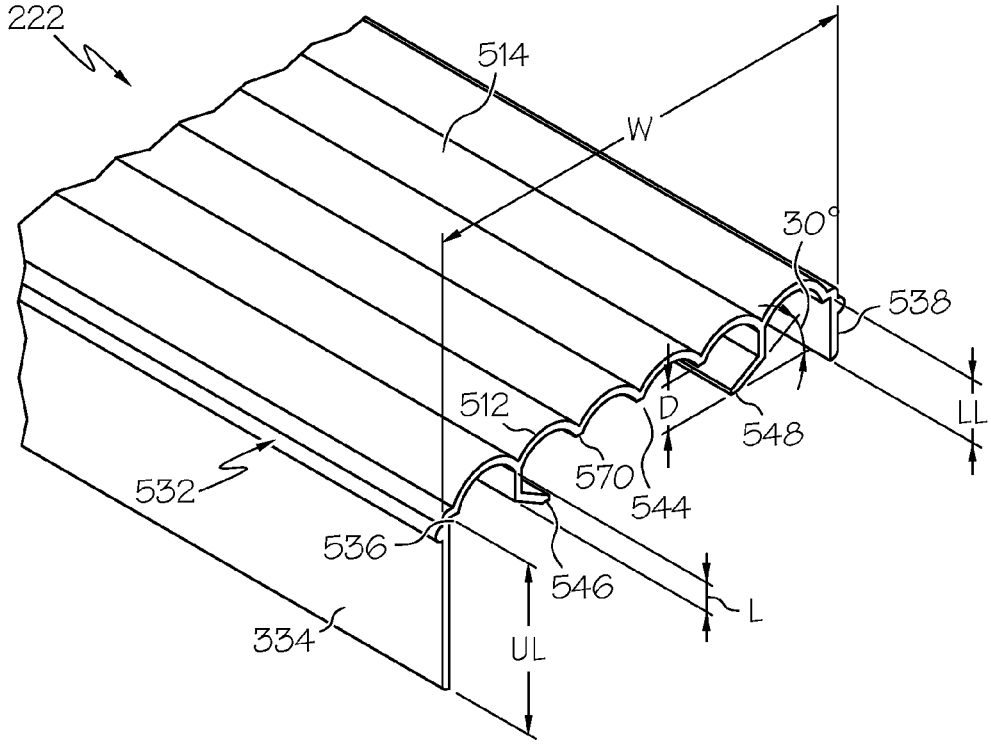
FIG. 5 is a side perspective of a decorative front cover of FIG. 3 for the first model.

FIG. 5 is a side perspective of a decorative front cover 222 of FIG. 3 of the first model. The front side 512 has a pattern for form a decorative surface 514. In this example the decorative surface 514 is a repeating series of semi-circular shapes as illustrated. Other shapes, patterns and decorations may be used to form the decorative font side 514, including various colors and textures. The pair of fingers 546 and 548 is formed in the back side 544. The fingers in one example are formed at approximately a 30 degree angle with respect to the horizontal plane parallel to the front 512 as shown. The length L of each finger 546 and 548 is approximately 0.32 inches and a depth D of approximately 0.25 inches. Together the pair of fingers 546 and 548 and the back 544 define a channel 570 sized to accept the finger mounts 466, 468 thereinto. The overall width W of the decorative front cover 222 is approximately 2.4 inches. This is slightly longer than the length L of the clasp 350 in FIG. 3. The top lip 334 of the decorative front cover 222 forms a void 536 into which top covering 232 is tightly sandwiched between the top lip 334 and the top surface 130 of the ventilated shelf 100. A small safety lip 532 is formed in the top lip 334 to keep items placed, such as cans and dry goods 105, on top of the top surface 130 from slipping off towards the front surface 514. The length UL of the top lip 334 is approximately 0.9 inches and the length LL of the bottom lip 538 is approximately 0.4 inches. The material thickness of various portions 334, 538, 546, 548 of the decorative front cover 222 is about 0.40 inches.

Figure 6:
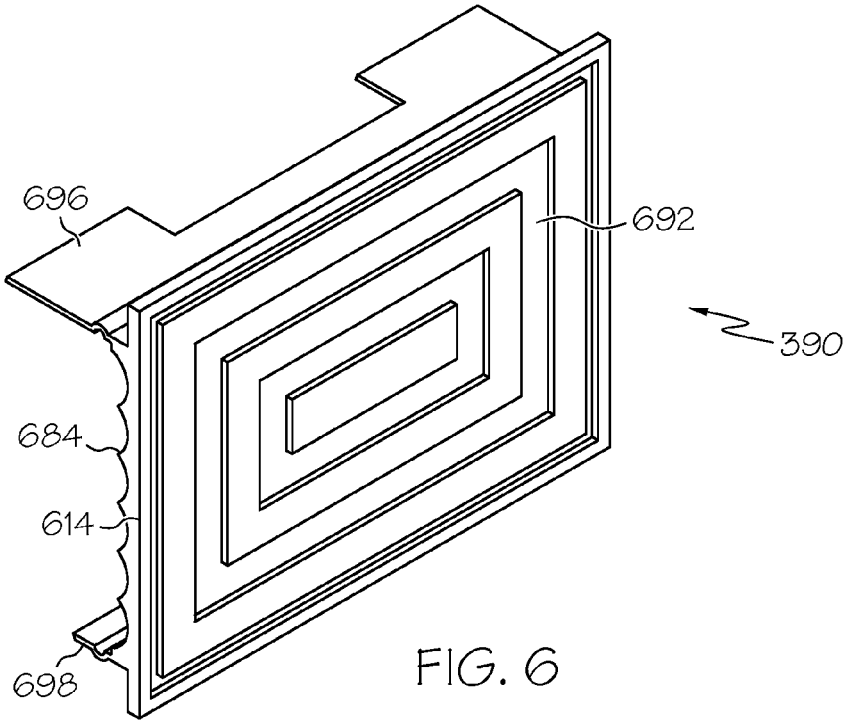
FIGS. 6-7 are various perspective views of a decorative cap of FIG. 3 for the first model.
Figure 7:
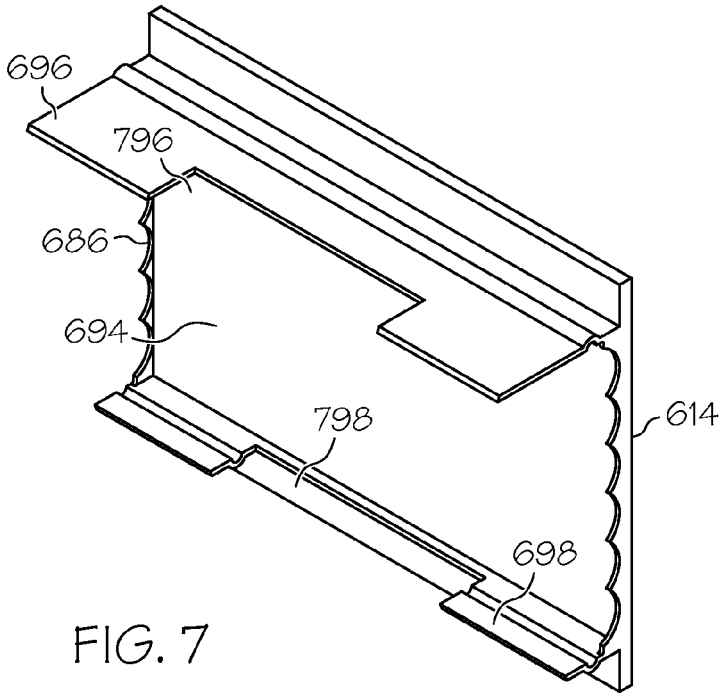

Turning now to FIGS. 6 and 7, show various perspective views of a decorative cap 390 of FIG. 3 of the first model. This decorative cap 390 is used in applications in which two decorative front cover 222 pieces together for a long shelf and/or in applications in which a vertical support pole 150 is used as part of the ventilated wire shelf 100 of FIG. 1. FIG. 6 illustrates a front side 692 with a decorative surface disposed 690 thereon. Like the decorative front surface 514 of the decorative front cover 222 illustrated is only one decorative example. Other shapes, patterns and decorations may be used to form the decorative surface 514, including various colors and textures. Also shown is a set of side walls 614, 616 that has been formed to fit closely over the decorative surface 514 of the decorative front cover 222. A top lip 696 with a top slot 796 and a bottom lip 698 with a bottom slot 798 are shown. Slots 796 and 798 are formed to accommodate the support pole 150 of FIG. 1 passing therethru.

Figure 8:
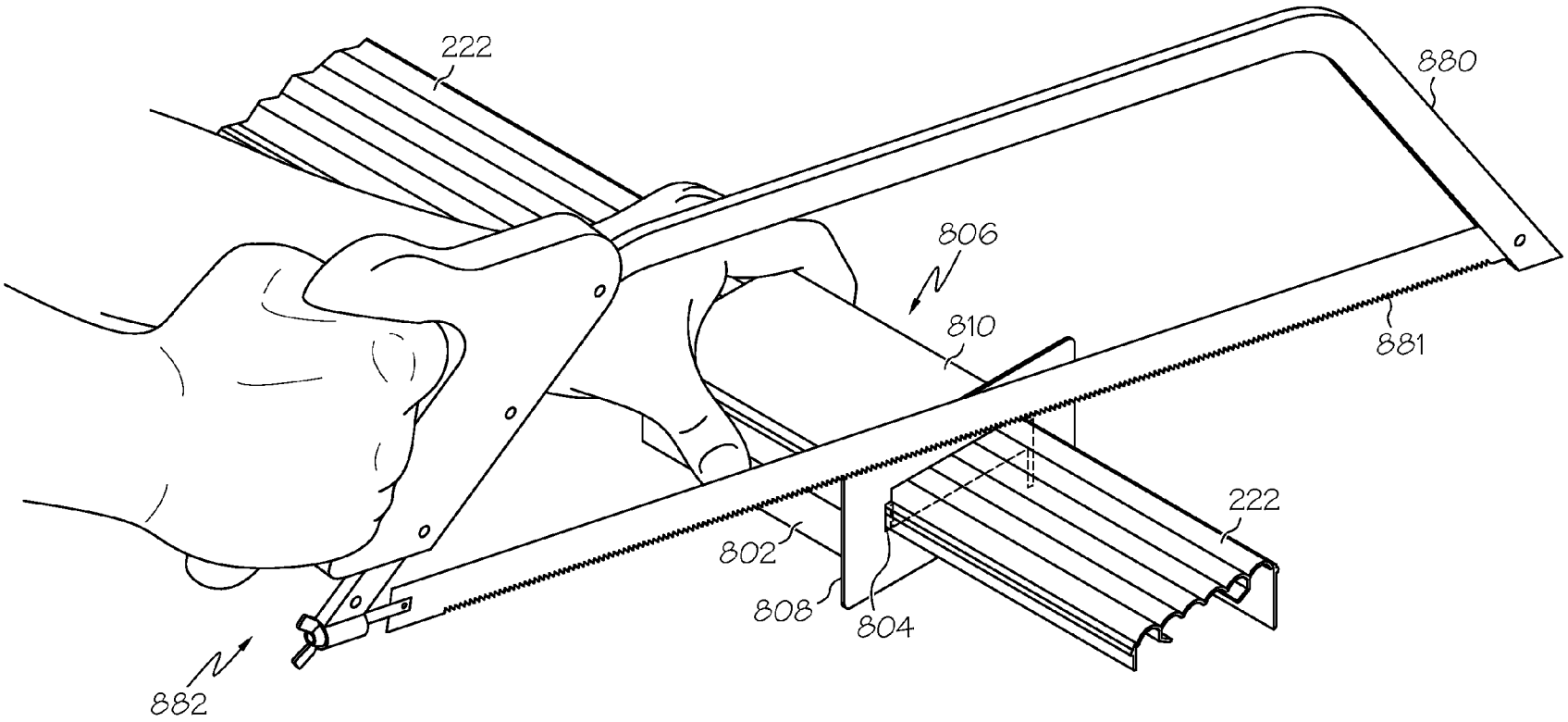
FIG. 8 is a saw guide used to cut the decorative front cover of FIG. 5 for the first model.

FIG. 8 is a saw guide 806 used to assist to cut the decorative front cover 222 of FIG. 5 to a desired length to match the length of a wire shelf 100. Shown is saw guide 806 with a passage 804 adapted to accept the decorative front cover 222 therethru. A lip 808 on the saw guide 806 provides guide to saw blade 881 of saw 880 when cutting the decorative front cover 222. In one example, the user holds sides 802 and 810 with his left hand and operates the saw 880 with his right hand. The decorative caps 390 can be used for joining two decorative front panels together in a long run or to join to decorative front panels together at a vertical support member of the wire shelf 100. In all cases the shelving system is designed to work with existing wire shelves for the pantry, linen, bedroom closets or garage shelves.

Second Model

Figure 9:
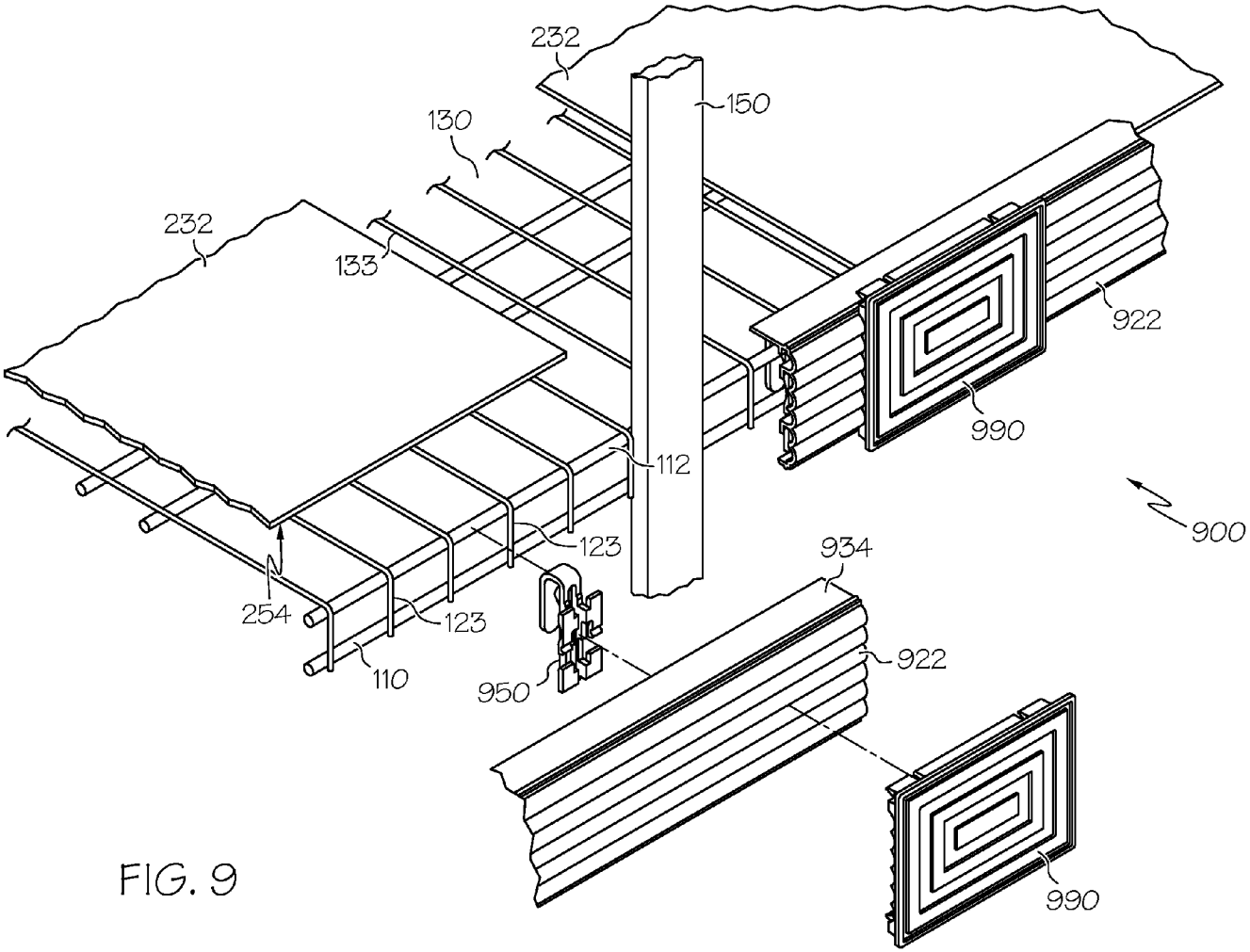
FIG. 9 is a front perspective explosion diagram illustrating major components of the ventilated shelving cover for a second model.

Referring to FIG. 9 shown is a front perspective explosion diagram 900 illustrating major components of the ventilated shelving cover 200 for a second model. The top covering 232 over the wires 133 on the top surface 130 and the decorative front cover 222 were described above in FIG. 2. The decorative front cover 922 as further described below includes a backside adapted to receive a clasp 950 and a top lip 934 to allow the top covering 232 to slip snugly underneath. Likewise, the clasp 950 is adapted to firmly attach to the backside of the decorative front cover 922 and over the top frame member 112 and the front edge 120 on the previously installed ventilated shelf 100. Also shown is a decorative cap 990 is used in applications in which two decorative front cover 222 pieces together for a long shelf. This decorative cap 990 is also used in applications in which a vertical support pole 150 is used as part of the ventilated wire shelf 100.

Figure 10A:
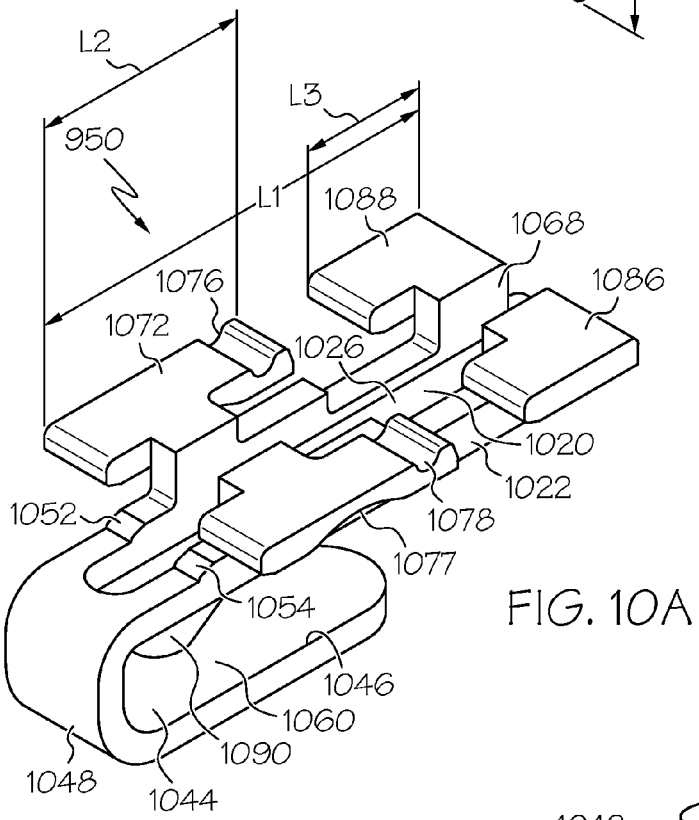
FIG. 10A is a top perspective view of a clasp of FIG. 9 for the second model and FIG. 10B is a bottom side view of the clasp of FIG. 9.
Figure 10B:
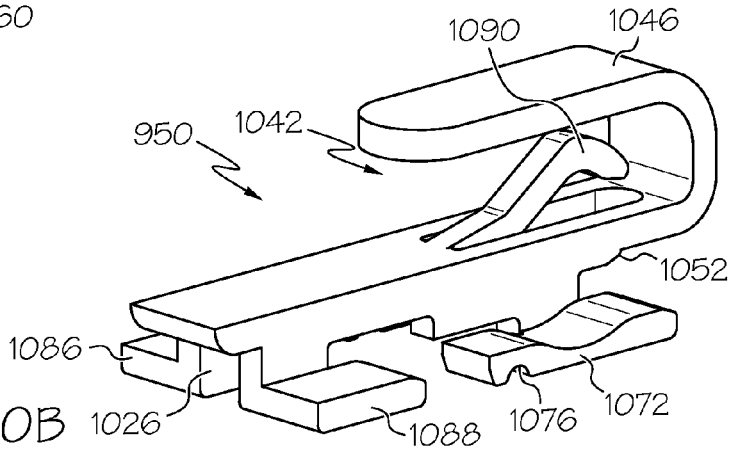

Referring now to FIG. 10A is a top perspective view of a clasp of FIG. 9 for the second model and FIG. 10B is a bottom side view of the clasp of FIG. 9. The clasp 950 is substantially J-shaped with a shorter first leg 1046 relative to a longer second leg 1068 joined together at a first end 1048 defining an opening 1044. In one example, the approximate overall length L1 of the clasp 950 is approximately 2⅛$^{th}$ inches to fit the front edge 120 of ventilated shelve 100, however other shorter and longer lengths are possible. The first leg 1046 and the second leg 1068 form an interior slot 1060. A second end 1042 is in communications with an interior slot 1060 that is sized to allow the top frame member 112 of the front edge 120 to pass through with a few pounds of force. A slot 1024 is formed running from the second end 1042 almost the entire length of the second leg 1068 to form two parallel portions 1020 and 1022 of the U-shaped body. The second leg 1068 includes a spring finger 1090 within the interior slot 1060 between the shorter first leg 1046 and the longer second leg 1068. An opening 1092 allows the spring finger 1090 to be urged into when moving over the top frame member 112 of the front edge 120. The second leg 1068 has a four mounting pads 1077, 1086, 1072, and 1088. The slot 1026 separates the four mounting pads into two symmetrical sets with a first set 1072, 1088 and a second set 1078, 1086. Each of the mounting pads 1077, 1086, 1072, and 1088 are a polygon shape. The mounting pads 1072 and 1076 each have a recess 1076 and 1078 as shown. In addition, the mounting pads 1072 and 1076 have a bevel 1052 and 1054 formed toward the first end 1048 as shown. The pads 1072 and 1077 each have a length L2 of about 0.75" and a width W of approximately 0.375". Pads 1086 and 1088 each have a length L3 of approximately 0.375". Each of these mounting pads 1077, 1086, 1072, and 1088, the bevels 1052 and 1054, and the recess 1076 and 1078 are formed and sized to firmly slide along the pair of fingers 1146 and 1148 defining a channel 1170 on backside 1114 of decorative front cover 922 as shown in FIG. 11.

Figure 11:
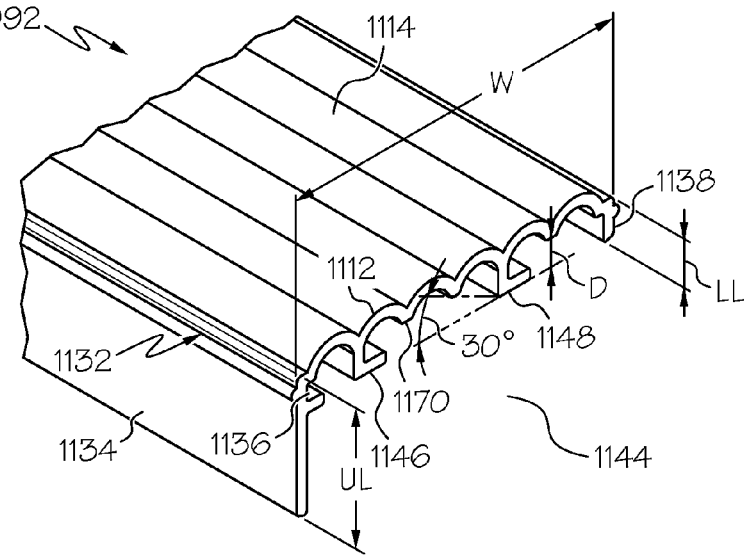
FIG. 11 is a side perspective of a decorative front cover of FIG. 9 for the second model.

FIG. 11 is a side perspective of a decorative front cover 992 of FIG. 9 of the second model. The front side 1112 has a pattern for form a decorative surface 1114. In this example the decorative surface 1114 is a repeating series of semi-circular shapes as illustrated. Other shapes, patterns and decorations may be used to form the decorative font side 1114, including various colors and textures. The pair of fingers 1146 and 1148 is formed in the back side 1144. The fingers in one example are formed at approximately a 30 degree angle with respect to the horizontal plane parallel to the front 1112 as shown. The length L of each finger 1146 and 1148 is approximately 0.32 inches and a depth D of approximately 0.25 inches. Together the pair of fingers 1146 and 1148 and the back 1144 define a channel 1170 sized to accept the first set of mounting pads 1072, 1088 and the second set of mounting pads 1077, 1086 thereinto. The overall width W of the decorative front cover 222 is approximately 2.4 inches. This is slightly longer than the length L of the clasp 950 in FIG. 9. The top lip 934 of the decorative front cover 222 forms a void 1136 into which top covering 232 is tightly sandwiched between the top lip 1134 and the top surface 130 of the ventilated shelf 100. A small safety lip 1132 is formed in the top lip 1134 to keep items placed, such as cans and dry goods 105, on top of the top surface 130 from slipping off towards the front surface 1114. The length UL of the top lip 934 is approximately 0.9 inches and the length LL of the bottom lip 1138 is approximately 0.4 inches. The material thickness of various portions 934, 1138, 1146, 1148 of the decorative front cover 222 is about 0.40 inches.

Figure 12:
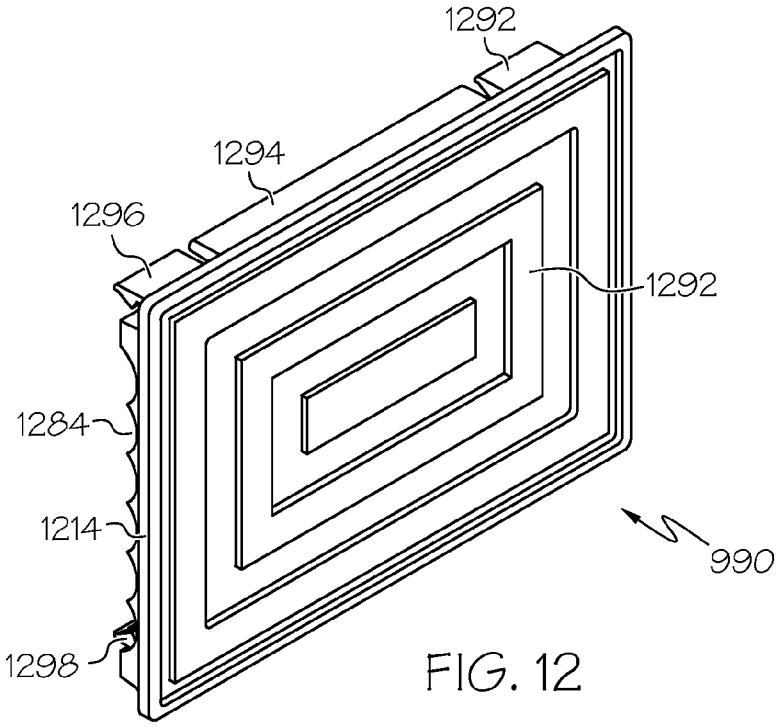
FIGS. 12-13 are various perspective views of a decorative cap of FIG. 9 for the second model.
Figure 13:
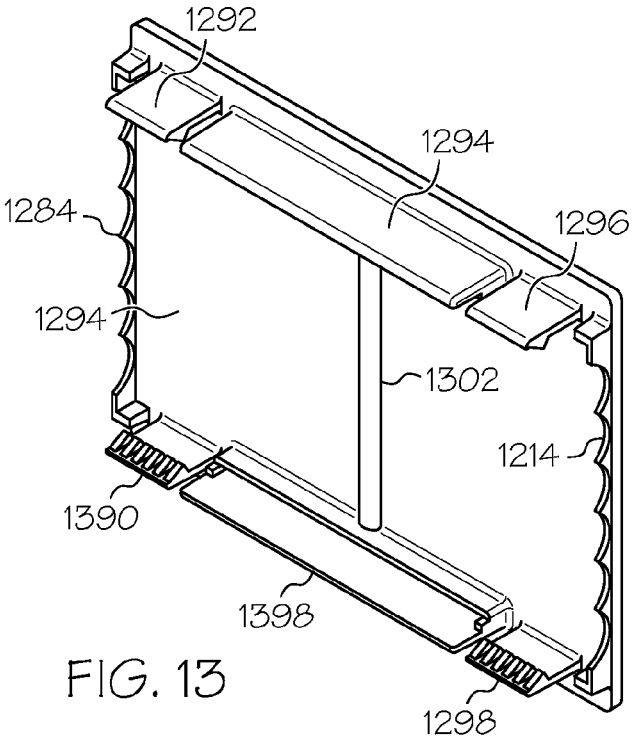

Turning now to FIGS. 12 and 13, show various perspective views of a decorative cap 990 of FIG. 9 of the second model. This decorative cap 990 is used in applications in which two decorative front cover 222 pieces together for a long shelf and/or in applications in which a vertical support pole 150 is used as part of the ventilated wire shelf 100 of FIG. 1. FIG. 12 illustrates a front side 1292 with a decorative surface disposed 1290 thereon. Like the decorative front surface 1114 of the decorative front cover 222 illustrated is only one decorative example. Other shapes, patterns and decorations may be used to form the decorative surface 1114, including various colors and textures. Also shown is a set of side walls 1214, 1216 that has been formed to fit closely over the decorative surface 1114 of the decorative front cover 222. A top lip 1296 with a top slot 1396 and a bottom lip 12698 with a bottom slot 1398 are shown. Slots 1396 and 1398 are formed to accommodate the support pole 150 passing therethru. The bar 1502 has been added to make the molding process when using plastic easier.

Figure 15:
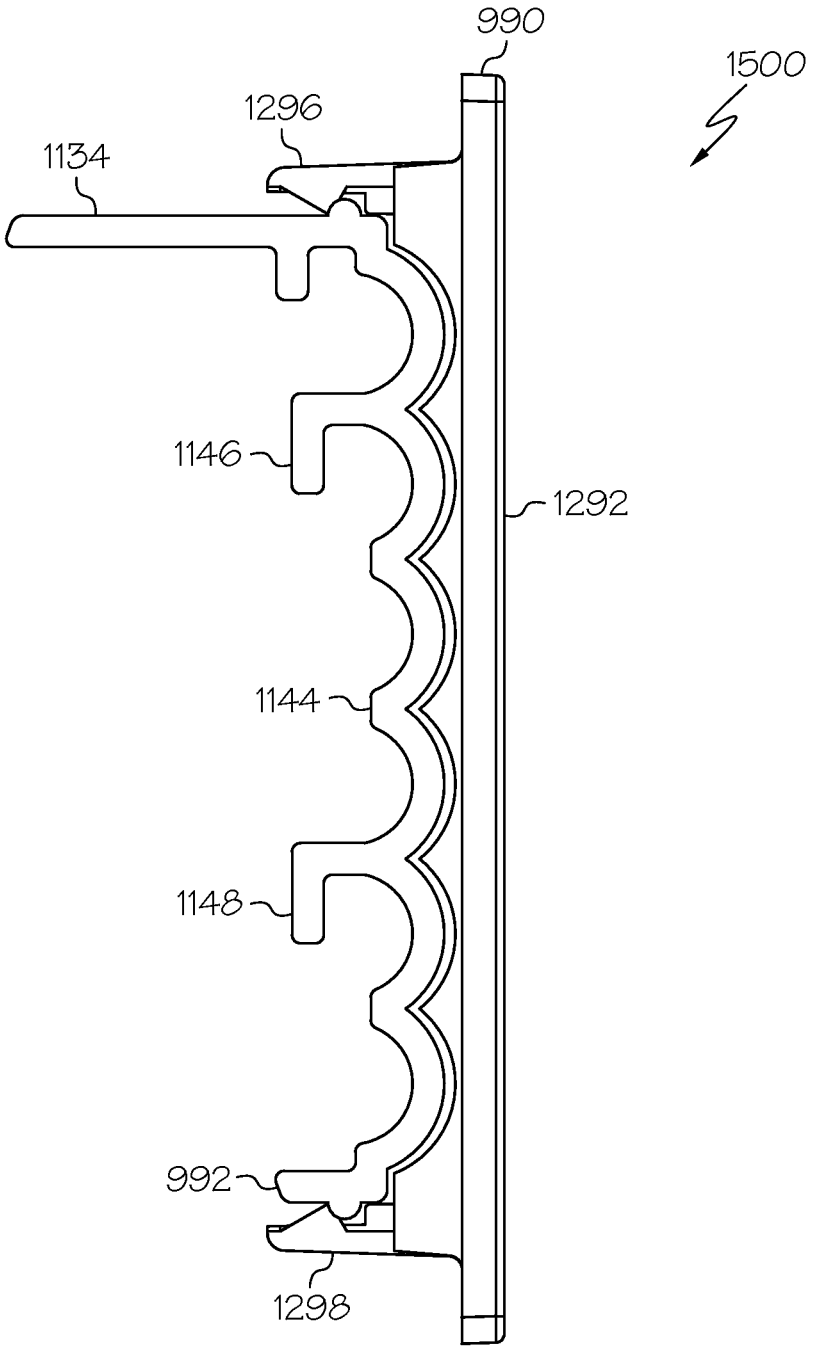
FIG. 15 side perspective view of the decorative front cover of FIG. 11 with the decorative cap of FIGS. 12-13 for the second model.

FIG. 15 is side perspective view 1500 perspective view of the decorative front cover of FIG. 11 with the decorative cap of FIGS. 12-13 for the second model. Shown is how the top lip 1296 and bottom lip 1298 of the decorative cap 990 mechanically mates with decorative front cover 992.

Figure 14:
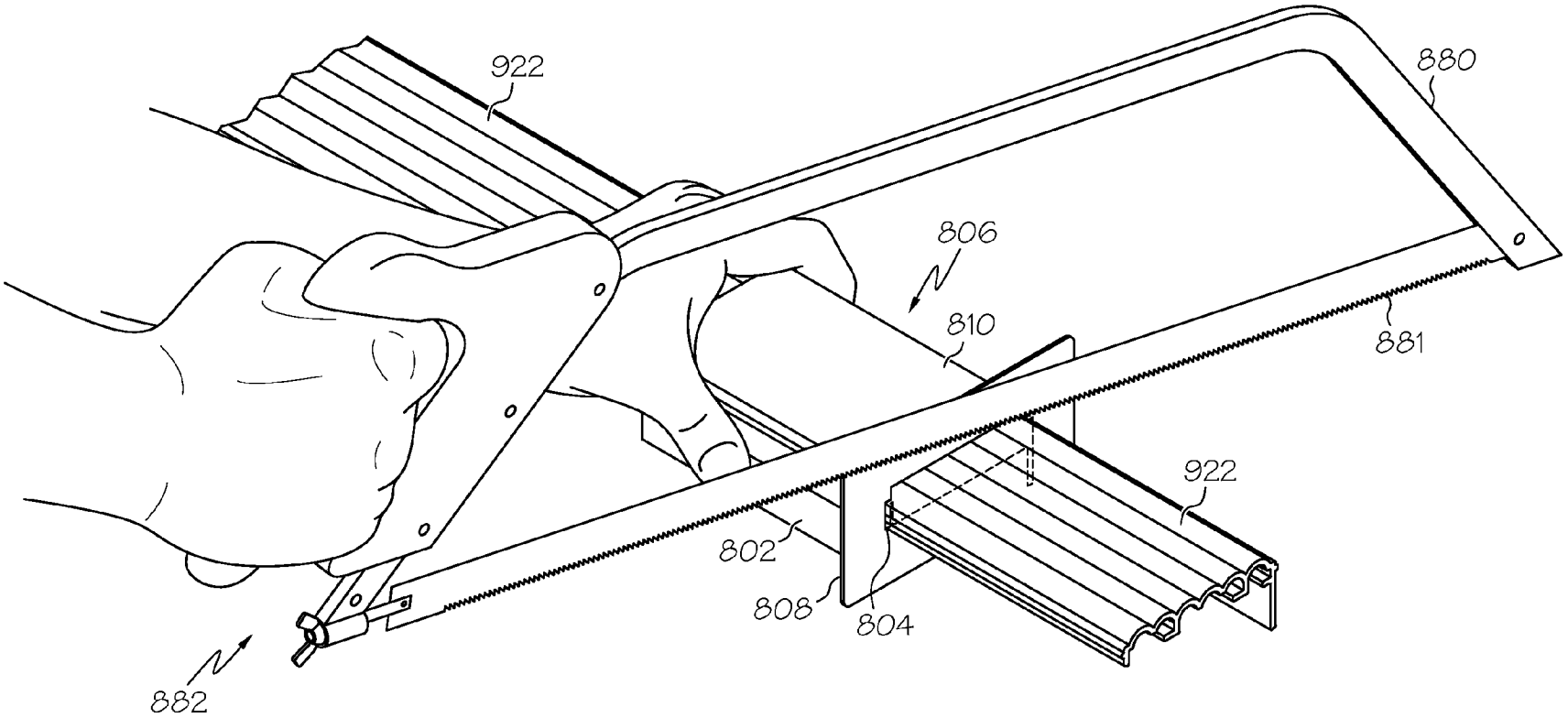
FIG. 14 is a saw guide used to cut the decorative front cover of FIG. 12 for the second model.

FIG. 14 is a saw guide 806 used to assist to cut the decorative front cover 222 of FIG. 11 to a desired length to match the length of a wire shelf 100. Shown is saw guide 806 with a passage 804 adapted to accept the decorative front cover 222 therethru. A lip 808 on the saw guide 806 provides guide to saw blade 881 of saw 880 when cutting the decorative front cover 222. In one example, the user holds sides 802 and 810 with his left hand and operates the saw 880 with his right hand. The decorative caps 390 can be used for joining two decorative front panels together in a long run or to join to decorative front panels together at a vertical support member of the wire shelf 100. In all cases the shelving system is designed to work with existing wire shelves for the pantry, linen, bedroom closets or garage shelves.

Non-Limiting Examples

The shelving system is available in a variety of styles, lengths and widths as well as different materials including simulated wood grain. The different materials to construct any of the components of FIG. 3 and FIG. 9 include plastics, composites, metals, wood, or a combination thereof.

It has been designed to be water and stain resistant and can easily be cleaned with a damp cloth.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A ventilated shelf cover comprising:

a decorative front cover with a front side and a back side and a top lip and a bottom lip disposed substantially perpendicular to the back side, and at least one pair of fingers disposed on the back side to define a channel therebetween; and a substantially J-shaped clasp with a first leg and a second leg and a first end attached to the first leg and the second leg, the first end having a substantially semi-circular opening in communication with an interior slot and a second end having a slotted opening in communication with the interior slot, and a set of substantially barbell shaped finger mounts, each of the substantially bar bell shaped finger mounts with a substantially rounded top edge, a substantially flat side edge, and a straight bottom edge defining a groove for accepting one of the pair of fingers thereinto.

2. The ventilated shelf cover of claim 1, further comprising:

a substantially flat covering with a front edge, and wherein the top lip and the back side of the decorative front cover defines a void sized to accept the front edge of the flat covering thereinto.

3. The ventilated shelf cover of claim 1, wherein a series of semi-circular ridges are disposed on a surface on at least one of the first leg and the second leg facing the interior slot.

4. The ventilated shelf cover of claim 3, wherein the second end of the first leg and the second leg include a bevel end angled towards the slotted opening therebetween.

5. The ventilated shelf cover of claim 4, wherein the top lip of the decorative front cover includes at least one safety lip disposed thereon, substantially parallel to the front side of the decorative front cover.

6. The ventilated shelf cover of claim 1, wherein a series of semi-circular ridges are disposed on a surface of the first leg and the second leg facing the interior slot.

7. The ventilated shelf cover of claim 1, wherein at least one of the second end of the first leg and the second leg include a bevel end angled towards the slotted opening therebetween.

8. The ventilated shelf cover of claim 1, wherein the top lip of the decorative front cover includes at least one safety lip disposed thereon, substantially parallel to the front side of the decorative front cover.

9. The ventilated shelf cover of claim 1, further comprising:

a decorative cap with front side with a decorative surface, a top lip with a slot and a bottom lip with a slot and a pair of side walls.

10. The ventilated shelf cover of claim 1, wherein the decorative front cover and the clasp are formed from a material including at least one of metal, plastic, composite, or combination thereof.

11. A ventilated shelf cover comprising:

a decorative front cover with a front side and a back side and a top lip and a bottom lip disposed substantially perpendicular to the back side, and at least one pair of fingers disposed on the back side to define a channel therebetween; and a substantially J-shaped clasp with a first leg and a second leg and a first end attached to the first leg and the second leg, the first end having a substantially semi-circular opening in communication with an interior slot and a second end having a slotted opening in communication with the interior slot, and at least a first set of mounting pads and a second set of mounting pads formed on top of the second leg, the first set of mounting pads and second set of mounting pads separated by gap, the first set of mounting pads and second set of mounting pads adapted to accept one of the pair of fingers thereinto, and a spring finger is disposed from the second leg extending into the interior slot.

12. The ventilated shelf cover of claim 11, further comprising:

a substantially flat covering with a front edge, and wherein the top lip and the back side of the decorative front cover defines a void sized to accept the front edge of the flat covering thereinto.

13. The ventilated shelf cover of claim 11, wherein a series of semi-circular ridges are disposed on a surface of at least one of the first leg and the second leg facing the interior slot.

14. The ventilated shelf cover of claim 11, wherein at least one of the second end of the first leg and the second leg include a bevel end angled towards the slotted opening therebetween.

15. The ventilated shelf cover of claim 14, wherein the top lip of the decorative front cover includes at least one safety lip disposed thereon, substantially parallel to the front side of the decorative front cover.

16. The ventilated shelf cover of claim 11, wherein the top lip of the decorative front cover includes at least one safety lip disposed thereon, substantially parallel to the front side of the decorative front cover.

17. The ventilated shelf cover of claim 11, further comprising:

a decorative cap with front side with a decorative surface, a top lip with a slot and a bottom lip with a slot and a pair of side walls.

18. The ventilated shelf cover of claim 11, wherein the decorative front cover and the clasp are formed from a material including at least one of metal, plastic, composite, or combination thereof.

* * * * *